United States Patent [19]

Serpas et al.

[11] 4,085,781

[45] Apr. 25, 1978

[54] MATERIALS DELIVERY SYSTEM FOR OFFSHORE TERMINAL AND THE LIKE

[75] Inventors: Luis B. Serpas, Belmont; Sam W. Small, Walnut Creek; Frederick S. Ellers, Menlo Park, all of Calif.

[73] Assignee: Bechtel International Corporation, San Francisco, Calif.

[21] Appl. No.: 685,966

[22] Filed: May 13, 1976

[51] Int. Cl.[2] ..... B65B 3/00

[52] U.S. Cl. ..... 141/1; 141/387; 137/615

[58] Field of Search ..... 141/387, 279, 284, 388, 141/389; 137/236, 615; 61/46, 48; 114/230; 9/8 P, 8.5

[56] References Cited

U.S. PATENT DOCUMENTS

| | | | |
|---|---|---|---|
| 3,498,325 | 3/1970 | Ashton et al. | 141/387 |
| 3,782,458 | 1/1974 | Slack | 141/387 |
| 3,800,547 | 4/1974 | Dutta et al. | 141/387 |
| 4,010,500 | 3/1977 | Reid | 141/387 |

*Primary Examiner*—Houston S. Bell
*Attorney, Agent, or Firm*—Townsend and Townsend

[57] ABSTRACT

A spar having fluid flow lines or material conveyors extending along the same is anchored by a ball joint, U-joint, elastic joint or the like to a base on the bottom of a body of water, such as a sea bottom. The spar has a buoyancy chamber near its upper end for applying an upward tension thereto at all times. When a vessel is adjacent to the upper end of the spar, tension means extends between the spar and structures on the vessel bow to couple the two together. The tension means provides a lateral force exerted on the spar to bias the spar toward the vessel even as the latter changes position relative to the spar due to current, wave and wind action. Several embodiments of the tension means are disclosed. The fluid flow lines carried by the spar connect a base manifold on the bottom of a body of water with delivery hoses or other conductors which can provide flexibility and are connected to the vessel for the transfer of crude oil and other fluids thereto. In lieu of fluid flow lines, material conveyors carried by the spar, such as bucket or pneumatic conveyors, can be used to raise particle material, such as manganese nodules and ore.

49 Claims, 22 Drawing Figures

FIG. 1
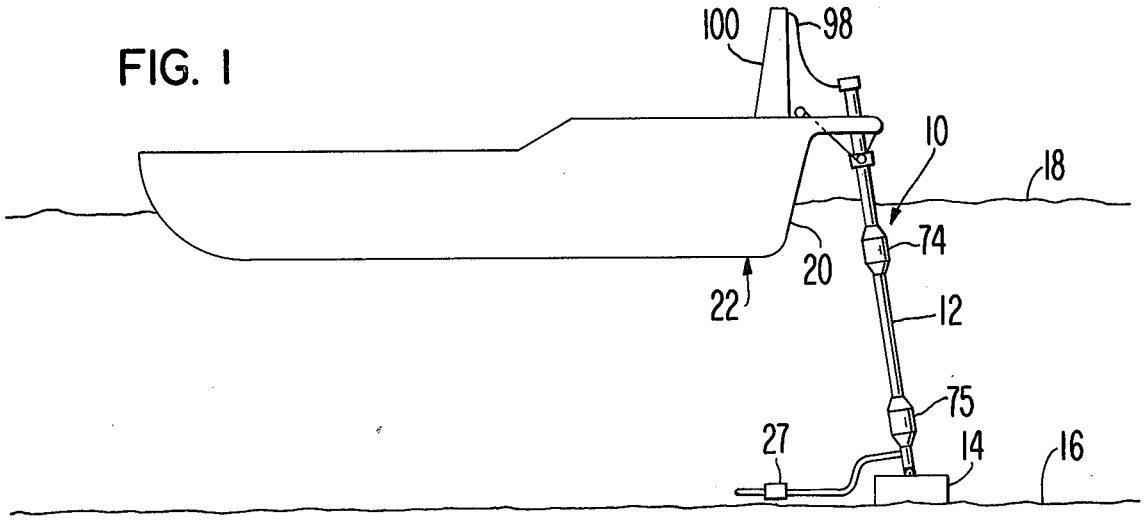
FIG. 3
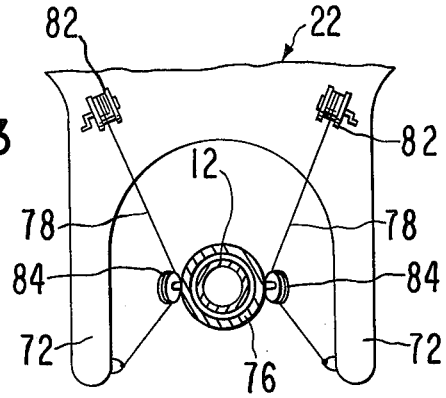
FIG. 2
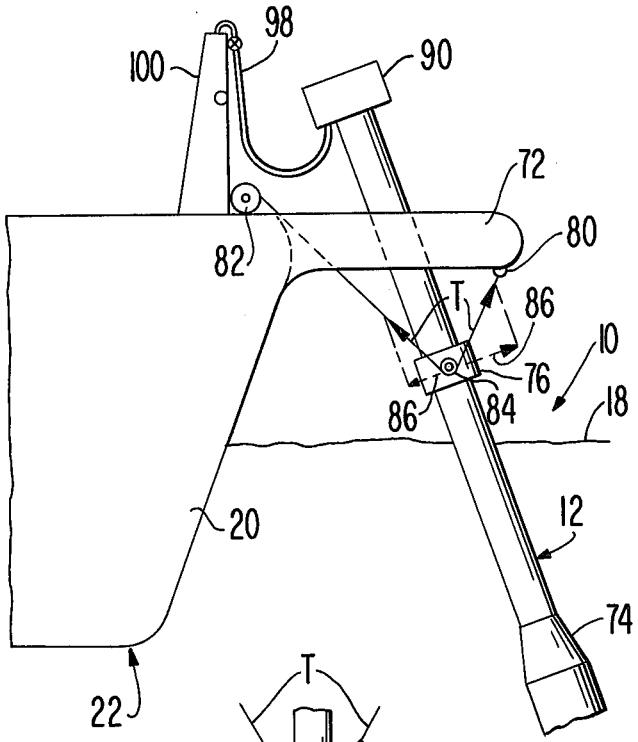
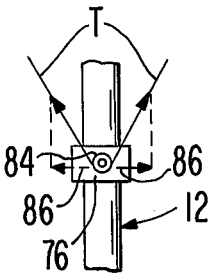
FIG. 2a
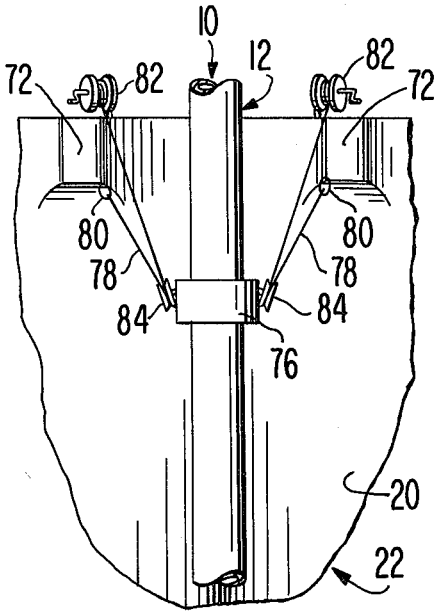
FIG. 4

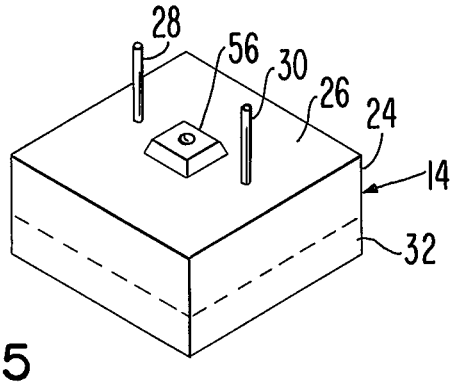
FIG. 5
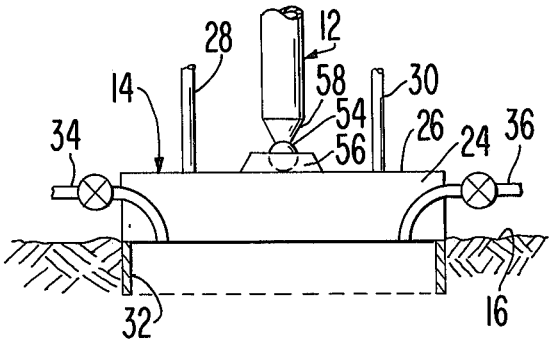
FIG. 6
FIG. 7
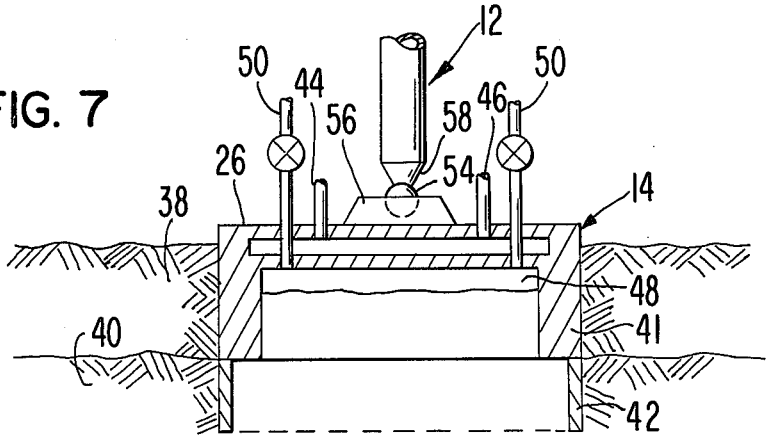
FIG. 7A
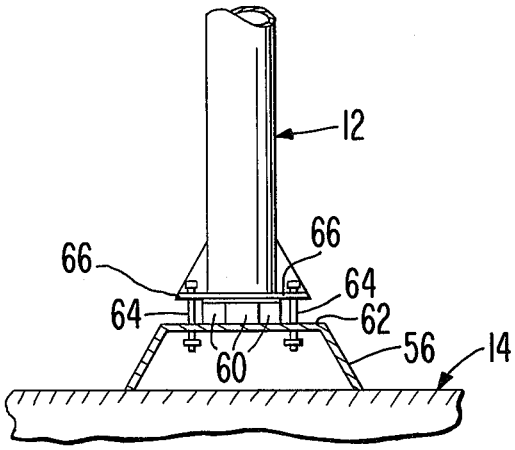
FIG. 7B
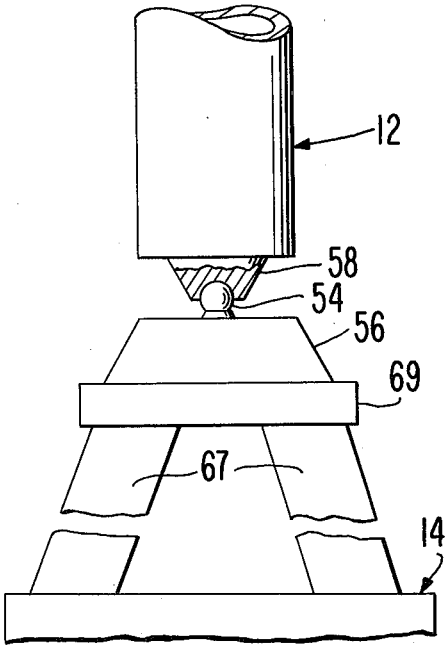

FIG. 8
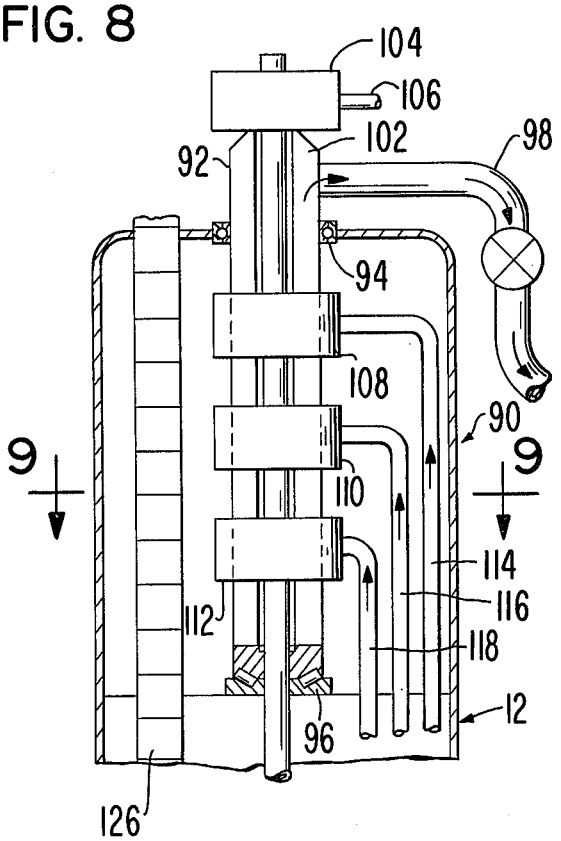
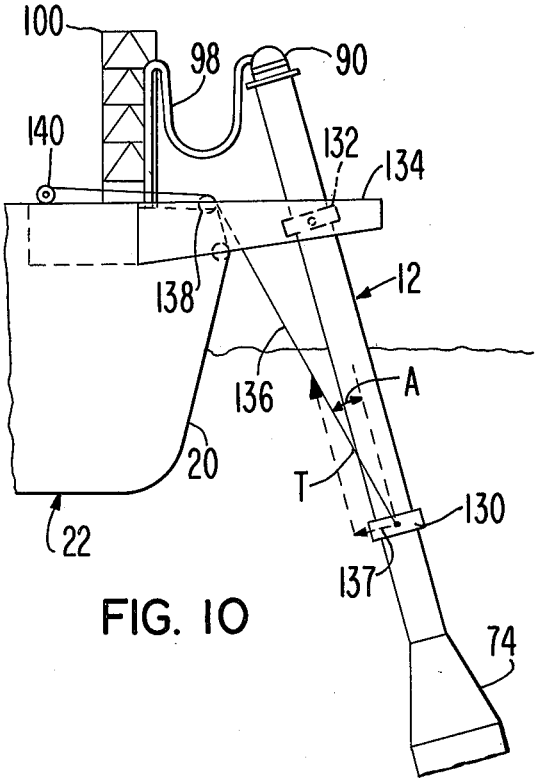
FIG. 10
FIG. 9
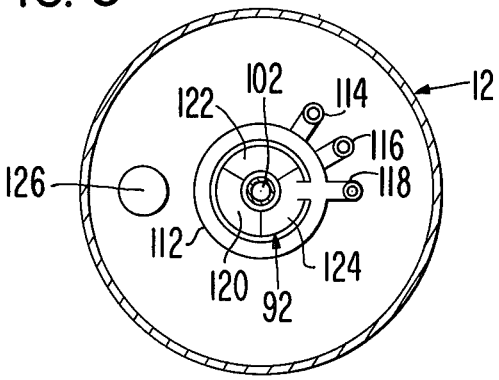
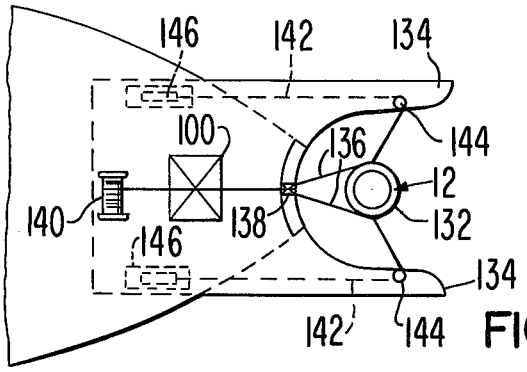
FIG. 12
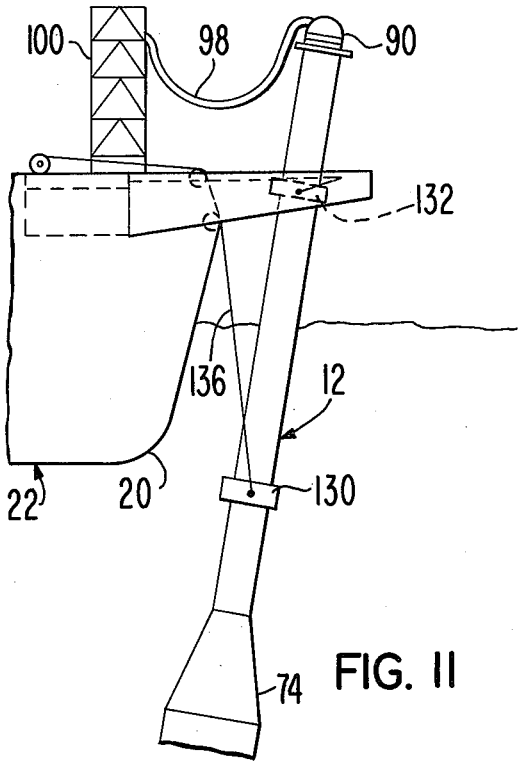
FIG. 11

MATERIALS DELIVERY SYSTEM FOR OFFSHORE TERMINAL AND THE LIKE

This invention relates to improvements in the transfer of materials mined or conveyed to a location on or below the bottom of a body of water to above-surface receptacles and, more particularly, apparatus and method for transferring such materials along a generally vertical path through the body of water even under extreme wave and weather condition at the surface.

BACKGROUND OF THE INVENTION

In the handling of crude oil pumped from offshore oil wells, a number of offshore terminals have been developed over the years for use in transferring the production from such wells to tankers at berth or to other receptacles or vessels. Among these are the following: the artificial offshore island made up of steel construction or precast concrete pilings fixed to the sea bottom and supporting steel, precast or cast-in-place concrete structures; the multiple-buoys-mooring system consisting of several mooring buoys anchored around a tanker berth; the tower mooring system consisting of a steel structure fixed to the sea bottom by piles and having a turntable fitted on the top of the structure from which a mooring rope is connected to a tanker at berth adjacent thereto; and the single point mooring system which can be of one of two types, namely, a catenary-chain type, single buoy mooring system or the single anchor leg mooring unit, both of which allow a tanker to rotate freely and to take the position of least resistance to combined external forces, such as those due to waves, sea currents, wind and other types of rotating moorings. All of these various systems can only be compared by selecting a particular site where such systems may be installed. At any such site, water depth and sea and weather conditions are to be considered along with the mooring forces between each system and a vessel to be associated therewith.

All of the foregoing systems have certain drawbacks, especially when the same are used in regions of the sea which have extreme wave action at certain times of the year. For instance, at certain locations in the North Sea where much offshore drilling now takes place, a 100-year wave is estimated to have a height of 95 to 105 feet but such estimates have lately been thought to be erroneous in that a more correct estimate is 150 feet. Under such extreme wave conditions, it is virtually impossible to maintain a mooring between a vessel and any one of the aforesaid offshore terminals without causing damage to both the vessel and the terminal. Also, to disengage and re-engage the vessel relative to the terminal in such extreme wave conditions, special structures and time consuming procedures are required.

The above-mentioned offshore terminals also have other drawbacks including restrictive water depth and excessive costs of construction and maintenance due to their complexity of structural detail. For instance, the artificial offshore island is so costly that its use seems justified only when the oil production handled thereby or throughput is very high, such as above 200,000 barrels per day, and only when very large vessels are available for use with it. Also, the waters around the island should be well protected; otherwise, a breakwater has to be constructed at high cost. Furthermore, the depth at which the aforesaid systems are operable do not exceed about 300 feet.

The multiple-buoys-mooring system finds it application only in protected shallow waters or exposed locations with mild wave climate and for relatively small tankers. It is otherwise too easily damaged; thus, it cannot withstand the extreme weather conditions mentioned above which occur in the North Sea.

The tower mooring system is costly to erect and to operate and presents collision risks. It is believed to find its best application only in relatively shallow waters which are protected from extreme wave action; thus, it is not suitable at all for the open North Sea operations discussed above.

The single point mooring system is not suitable for use under extreme wave conditions because, in the case of the single buoy mooring system, the hawsers which anchor the tanker or vessel break due to impact tension caused by wave forces exerted on the system. These waves also cause the buoy to separate from the vessel and then to slam into it to cause damage to either or both of them. In the case of the single anchor leg mooring system, an anchor chain connects a buoy body to a generally rigid vertical riser standing upwardly from the sea bottom but this chain also breaks due to extreme wave action and separates the buoy from the riser, causing sufficient damage to the system to requires replacement of the buoy, all of which requires a long shutdown time for repairs.

In view of the problems associated with the offshore oil terminals mentioned above, a need has arisen for an improved offshore terminal which is simple and rugged in construction, is relatively inexpensive to produce and maintain, can be easily moved to other locations, can be used to keep a vessel coupled thereto even under extreme wave conditions yet the vessel can safely engage with and disengage from the terminal without special assistance or procedures, and can operate at depths of up to 2,000 feet or more.

SUMMARY OF THE INVENTION

The present invention satisfies the aforesaid need by providing an improved materials delivery system for transporting materials from the bottom of a body of water to the surface and to a receptacle, such as a vessel coupled with the system itself. The present invention is especially suitable for handling offshore oil well production although it is suitable for other applications as well. For instance, it can be used to deliver natural gas from such offshore wells, and it can also deliver particle material, such as manganese nodules and ore, and can also deliver refrigerated fluids and slurries of various types. In the case of slurries, ocean mining can be carried out which would allow dredging marine deposits of tin, diamonds, gold or high value commodities under sea conditions in which conventional dredges are impractical or impossible for use.

The materials delivery system of this invention uses a spar having a relatively small cross section and provided with means for applying upward tension force thereon when the lower end of the spar is anchored by a suitable mass anchor base or is pile anchored or hydro-anchored to the bottom of a body of water. The coupling between the mass base and the spar can be a ball joint, a U-joint, an elastic joint or other structure permitting articulation of the spar relative to the base so that the spar, when coupled to a vessel on the surface of the water, can move with the vessel due to wave action without becoming separated from the vessel. It is also possible to make the spar flexible and to attach it by a rigid connection to the anchor base. This latter feature would be advantageous in deep water. The base can either be permanent or of a removable type, the latter being much more economical to relocate to another site than presently existing structures.

Tension is applied at all times to the spar by a buoyancy chamber carried by the spar adjacent to but below the upper end thereof. When a vessel is adjacent to the spar, it is coupled by tensioning means to the spar, and the tensioning means applies an additional tension force to the spar in a manner such that a lateral tension component is exerted on the spar at all times during the vessel-spar connection to hold the spar against the vessel. This feature virtually assures that they will not separate from each other even during periods involving extreme wave and wind conditions on the water surface. This will prevent impacting of the spar and the vessel together to thereby eliminate any structural damage to either or both of them due to this cause. The connection of the tension means to the spar is by way of a swivel so that the vessel can windvane without causing rotation of the spar about its longitudinal axis. Any of several embodiments of the tensioning means can be used to carry out the teachings of the present invention.

The normal or rest position will ordinarily be generally vertical. However, it can be normally tilted by adjusting the amount of buoyancy provided by either or both of the buoyancy chamber and the tensioning means.

The spar can be provided with one or more external or internal material delivery lines, such as fluid flow lines or conveyors for particle material, coupled at their lower ends to a materials source near the mass anchor base, the delivery lines extending to swivel means near the upper end of the spar, whereby the material delivery from the delivery lines can be transferred by material delivery means to the vessel or other receptacles regardless of the location of the vessel or receptacle about the spar. Control means can also extend through the core and the spar to operate control equipment on the bottom of the body of water. If the delivery lines are comprised of fluid flow lines, the buoyancy chamber itself can be provided with a manifold to permit a decrease in the fluid pressure of the flow lines and to reduce the number of flow lines to swivel coupled to the delivery hoses connected to the vessel.

If material conveyors are used, they can be bucket conveyors or hydro-pneumatic (airlift) or pneumatic conveyors, for delivery of particle material, such as manganese nodules or ore, to the water surface. Such materials can be raised in slurry form through fluid flow lines as an alternate approach.

The system is suitable for depths from 250 feet to more than 2,000 feet below the water surface and can be used to replace all existing offshore terminals of the conventional types described above. It is simple in construction, readily installable in place, and requires a minimum of maintenance.

The swivel at the top of the spar can be constructed to handle segregated products, such as crude oil and natural gas or particle materials of several different kinds. Such products would not be co-mingled at the swivel and they could be transferred by respective flexible delivery hoses or conductors to a vessel or other receptacles and into segregated storage areas thereon.

The primary object of this invention is to provide an improved materials delivery apparatus and method for the transfer of mined materials from the bottom of a body of water to a receptacle on the water surface wherein a spar having tension exerted thereon is used to support material transfer means extending from the bottom of a body of water to the water surface in a manner to permit transfer of materials to the receptacle even during extreme wave action on the water surface, yet the spar can be engaged with and disengaged from the receptacle under such conditions without the need for special assistance or procedures to carry out this purpose.

Another object of this invention is to provide a materials delivery system including a spar coupled by tensioning means to a vessel in a manner to permit the vessel to windvane and to become readily engaged with and disengaged from the spar without special structure, yet the spar and the vessel, when coupled together, are kept from separating and from impacting against each other even under extreme wave conditions, whereby damage to one or both of them is avoided.

Still another object of this invention is to provide an improved spar for articulation with a base on the bottom of a body of water wherein the spar has material transfer means extending along the same and is provided with means for applying an upward tension force thereto so that it will remain in a generally upright position and can be readily engaged with and disengaged from a vessel or other receptacle without damage to the spar or the tension means thereof even during periods of extreme wave and wind condition at the water surfaces.

Another object of this invention is to provide a system of the aforesaid character wherein the spar is anchored to the bottom of a body of water by an improved base to which ballast in slurry form can be pumped into and out of, whereby the base is removable from one job site and can be transferred to another job site merely by pumping ballast out of the same.

Other objects of this invention will become apparent as the following specification progresses, reference being had to the accompanying drawings for several embodiments of the invention.

In the drawings:

FIG. 1 is a schematic view of the articulated tension spar of this invention showing one of several uses of the same, namely, for transferring crude oil from an underwater well to a vessel at berth near the upper end of the spar;

FIG. 2 is a side elevational view of the upper end of the spar, showing the way in which tension is applied thereto when the same is coupled to laterally projecting horns on the bow of the vessel;

Figure 13:
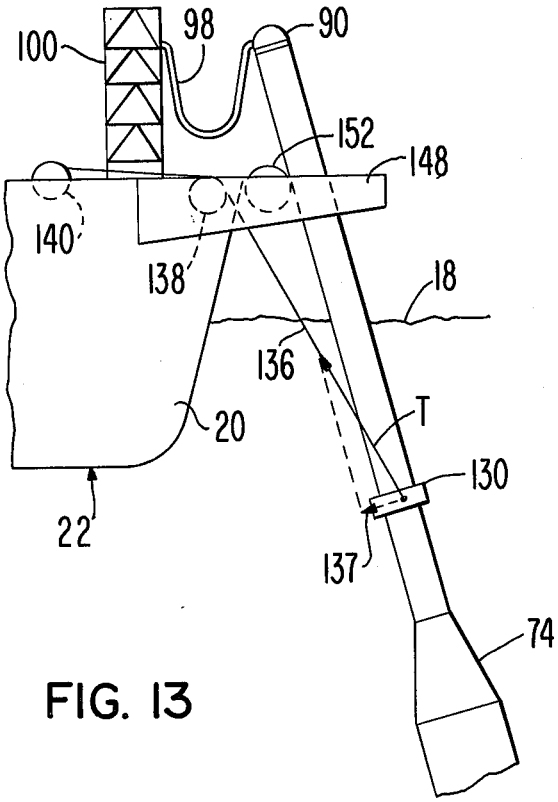
Figure 14:
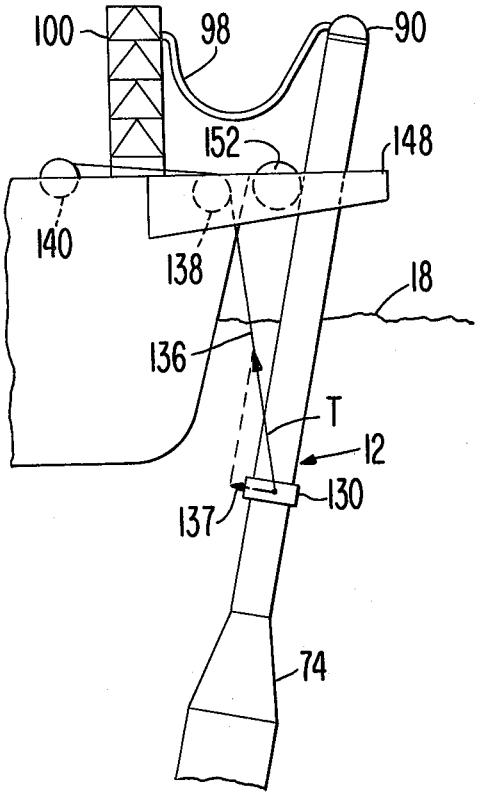
Figure 15:
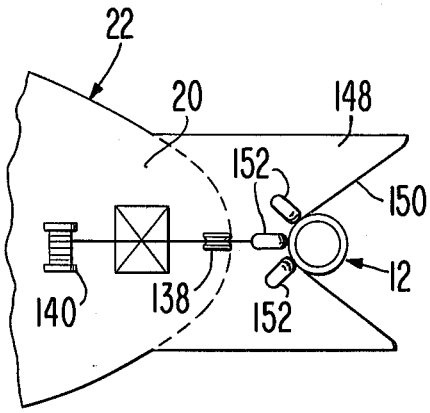
Figure 16:
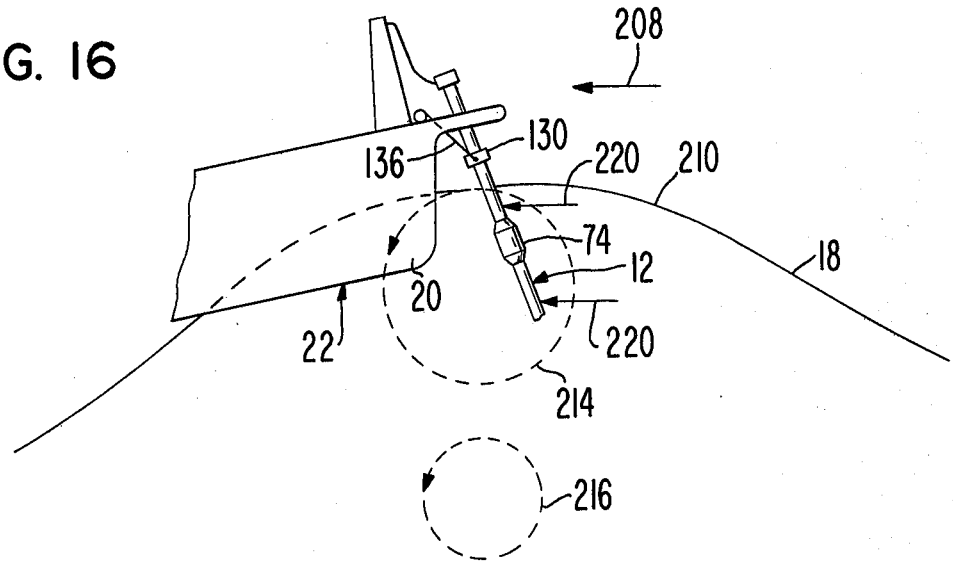
Figure 16A:
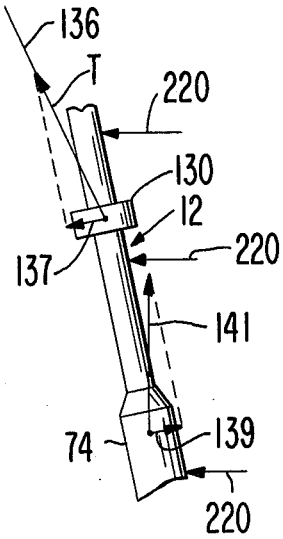
Figure 16A:
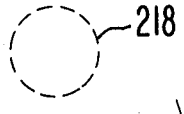
Figure 16B:
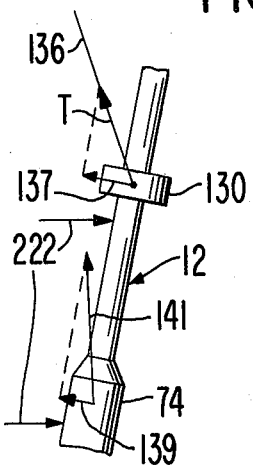
Figure 17:
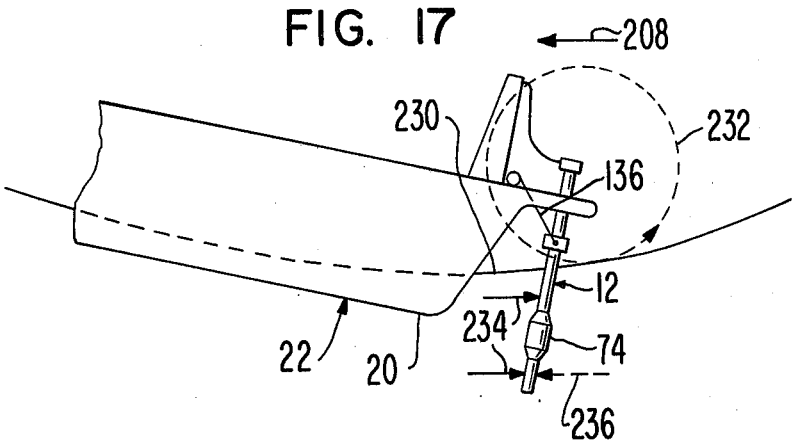

FIG. 2*a* is a fragmentary view of the spar and tensioning system when the spar is in its vertical position;

FIG. 3 is a top plan view of the spar tensioning system of FIG. 2;

FIG. 4 is a front elevational view of the spar tensioning system of FIG. 2;

FIG. 5 is a perspective view of a preferred embodiment of the mass anchor base for the spar;

FIG. 6 is a side elevational view, partly in section, of the mass anchor base when the same is embedded in the bottom of a body of water, showing the spar mounted by a ball joint on the base;

FIG. 7 is a view similar to FIG. 6 but showing another embodiment of the base suitable for use when the bottom of the body of water is covered by a layer of soft mud;

FIG. 7*a* is a view similar to FIGS. 6 and 7 but showing another way in which the spar is coupled to the base;

FIG. 7*b* is a view similar to FIG. 7*a* but showing a tripod or a pyramidal structure coupling the spar and the base;

FIG. 8 is an enlarged, fragmentary, view of the upper end of the spar showing the way in which fluid flow lines through the spar are coupled by means of swivels to a fluid swivel core and one or more delivery hoses or conductors to a vessel or other receptacle;

FIG. 9 is a cross-sectional view taken along line 9—9 of FIG. 8;

FIG. 10 is a view similar to FIG. 2 but showing another tensioning system between the spar and a vessel with the spar in a substantial windvane position relative to the vessel;

FIG. 11 is a view similar to FIG. 10 but showing the spar in a substantial override position;

FIG. 12 is a top plan view of the system of FIG. 10;

FIG. 13 is a view similar to FIGS. 2 and 10 but showing a third embodiment of the tensioning system between the spar and the vessel, the spar being in a substantial windvane position relative to the vessel;

FIG. 14 is a view similar to FIG. 13 but showing the spar in a substantial override position;

FIG. 15 is a top plan view of the system of FIGS. 13 and 14;

FIG. 16 is a schematic view of the spar and vessel of FIGS. 13–15 at the crest of a wave;

FIG. 16*a* is a fragmentary view of the spar showing the wave and tension forces exerted thereon at the crest of a wave when the wave moves in the direction shown in FIG. 16;

FIG. 16*b* is a view similar to FIG. 16*a* but showing the forces on the spar at the trough of a wave when the wave moves in the direction shown in FIG. 16; and FIG. 17 is a view similar to FIG. 16 but showing the spar and vessel at the trough of a wave.

For purposes of illustration only, the materials delivery system of the present invention will hereinafter be described as a means for transferring crude oil or gas through fluid flow lines from a base manifold coupled to one or more wells drilled into the bottom of a body of water to a vessel floating on the surface at a location above the wells. Crude oil will hereinafter be described as the fluid to be handled by the system of the present invention. The invention is, however, broader in scope than this illustrative example, since it can be used to raise particle material, such as manganese nodules or ore, to the surface of a body of water by the use of conveyors.

The concept of the present invention is illustrated schematically in FIG. 1 wherein the delivery system, denoted by the numeral 10, includes an elongated, tubular, spar 12 mounted on a base 14 on the bottom 16 of a body of water which will hereinafter be considered as a sea so that bottom 16 will be referred to as the sea bottom. Spar 12 extends upwardly from the base to and above the upper surface 18 of the sea and terminates near the bow 20 of a vessel 22, which will hereinafter be described as a tanker, although such a vessel can include any type of marine craft, such as a barge, ore ship, floating pier and the like.

Base 14 is positioned on the sea bottom in the vicinity of one or more oil wells, typically six in number, which may be spaced from each other at varying distances. Fluid flow lines from the various wells and the associated equipment, such as valves, regulators, controls, pumps and the like, are provided to direct the crude oil from the well heads to a base manifold 27 and then into spar 12 for transit through one or more fluid flow lines extending through the spar to its upper end and then, by way of other conduit means, to the tanker as hereinafter described.

Base 14 is shown in its preferred embodiment in FIGS. 5 and 6. The base can have any suitable shape but, for purposes of illustration, it comprises a generally square, octagonal or round hollow housing 24 having a top 26 provided with a pair of tubes 28 and 30 communicating with the interior thereof. Tubes 28 and 30 extend either into spar 12 or extend upwardly to upper surfaces 18 along the outer surface of the spar. They are used for directing a ballast into housing 24 when it is desired to anchor the same on sea bottom 16.

A typical ballast is a slurry or iron ore, magnetite, sand, or some other heavy material in slurry form to be pumped from the surface into housing 24. This type of ballast will allow good control of the submergence of base 14 since no compressible gas or fluid is used for this purpose. Also, by using tubes 28 and 30, the ballast can later be fluidized within housing 24 and ejected if it becomes desirable to move base 14 to another job site. Typically base 14 is made slightly positive in buoyancy to facilitate its transport to a job site. A typical ballast weight is 1500 tons or more.

Housing 24 may be of one or several compartments either connected to or independent of each other. In the latter case, each independent compartment would have its own tubes 28 and 30. The compartments may be tubular and may be set up in the particular geometric configuration to suit the sea and soil conditions of the site.

Housing 24 has a continuous penetration skirt 32 secured to and extending from the bottom of the housing as shown in FIGS. 5 and 6. This skirt is adapted to penetrate the sea bottom to provide a positive anchor for the base. The skirt provides a hydraulic seal for the bottom of housing 24, and relief tubes 34 and 36 extending outwardly from opposite side of the housing and through the bottom thereof can be used to provide a reduced pressure or suction in the space surrounded by the skirts to permit differential, hydraulic pressure to force skirt 32 into the sea bottom. Tubes 34 and 36 are connected to a suitable suction force, such as on the vessel which is used during installation of the base.

To disengage housing 24 from the sea bottom, the region below the bottom of the housing can be pressurized through tubes 34 and 36 to assist skirt 32 to move out of the sea bottom. Then, by ejecting the ballast from housing 24, the base can then be moved to a new job site. The ballast can be ejected from the housing through either the bottom of the housing or other tubes through the housing by conventional means.

In some cases, the sea bottom in deep water comprises a layer 38 (FIG. 7) of soft, fine sand and silt bottom, the layer being 15 or more feet thick and resting on a good bearing bottom 40. In such a case, the footing of layer 38 is too weak to support base 14. In such a case, the base will have a different construction from that shown in FIGS. 5 and 6 and will include a continuous sidewall 41 (FIG. 7) secured to a housing 43 and extending downwardly therefrom. A continuous penetration skirt 42 will extend downwardly from the sidewall 41 as shown in FIG. 7, housing 43 being hollow and provided with tubes 44 and 46 for the same purpose as tubes 28 and 30 of FIGS. 5 and 6. Continuous sidewall 41 is used to increase the pressure on layer 38 so that skirt 42 can more effectively penetrate the layer and then extend into the good bearing material 40 below the layer. The interior of the space surrounded by sidewall 41, denoted by the numeral 48, can be exhausted by a pair of tubes 50 connected to a suitable suction source. Space 48 can be pressurized when it is desired to remove base 14 from the sea bottom and to move it to another job site.

One way of mounting spar 12 on base 14 is by the use of a ball joint 54 (FIGS. 6 and 7) with the ball of the joint being mounted on a suitable pedestal 56 on top 26 of base 14 and with spar 12 having a socket member 58 at its lower end for coupling the spar with the ball. The spar is thus able to articulate relative to the base 14 in all directions about horizontal axes through the ball; however, the coupling is provided with means (not shown) for preventing rotation of spar 12 about its longitudinal axis relative to the ball joint. In lieu of a ball joint, a universal joint can be used for this same purpose.

Other embodiments of the action between the spar and the base are shown in FIGS. 7*a* and 7*b*. In FIG. 7*a*, pedestal 56 is provided with an elastic ring or elastic blocks 60 which rest upon and are connected to the flat upper surface 62 of the pedestal and which support and are connected to the bottom of spar 12. To limit the compression of blocks 60 when spar 12 has a tendency to tilt with respect to the vertical, a number of limit bars or springs 64 may be used and, if used, are secured between pedestal 56 and respective lateral ears 66 on the lower end of spar 12. Limit bars 64 prevent the deformation of blocks 60 beyond its elastic limit. In any case, blocks 60 allow spar 12 to articulate relative to base 14 in all directions about generally horizontal axes through the block, and limit bars 64 prevent spar 12 from rotating about its longitudinal axis relative to the base.

To enhance the structural behavior and the economics of a very long spar in deep waters, base 14 could be fabricated to contain a tripod or a pyramidal structure of three or more legs 67 as shown in FIG. 7*b*. All of the flow lines could be made to extend through the base and legs 67 and into spar 12. At the top of the pyramid is a platform 69 to mount pedestel 56, 54, and socket member 58. This feature will allow the use of a relatively short spar since legs 67 can be made relatively long.

Spar 12 is of relatively thin-wall steel construction, such as a 2-inch wall thickness, and is relatively small in diameter, typically about 10 feet in diameter. In the alternative, the spar could be of concrete and steel or other suitable material. The length of the spar typically is from 250 to 450 feet but can be as long as 2,000 feet or more. The length will be such that the upper portion of the spar will extend upwardly from upper surface 18 and through the space 70 (FIG. 3) between a pair of spaced, generally parallel bow horns 72 mounted in any suitable manner on bow 20 of tanker 22. The upper end of the spar terminates above the bow horns as shown in FIGS. 1 and 2, for instance.

Spar 12 has a buoyancy tank 74 (FIG. 1) mounted thereon near the upper end thereof and below surface 18. Tank 74 provides buoyancy for spar 12 and provides a tension force which is exerted on the spar in an upward, axial direction at all times even when tanker 22 is separated from the spar. Thus, the spar can be of relatively small diameter. When the tanker is in berth, the spar is further tensioned by a spar tensioning system in a manner hereinafter more fully described.

Buoyancy tank 74 can be designed with either or both air and buoyant material-filled buoyancy chambers. Also, it can be somewhat enlarged so that it can enclose one or more flow line manifolds to allow reduction in flow line pressures from about 3,000 psi to about 300 psi. When a large number of flow lines are being brought into the spar, one or more manifolds at this location will reduce the output lines to one or more from the spar to the tanker.

Under certain conditions, spar 12 may have a ballast tank 75 (FIG. 1) near its lower end for receiving ballast to assist in putting the spar in place. Ballast tank 75 reduces the upward forces on base 14 and assists in keeping spar 12 in an upright position if, for some reason, the spar separates from the base. Ballast tank 75 can have a number of compartments and can be helpful in towing the spar to a job site since tank 75 will be buoyant with no ballast in it and can cooperate with base 14 when the latter is free of ballast to provide a buoyant force on the lower end of the spar so that the spar can be towed in a generally horizontal position, the front end of the spar being buoyed by tank 74.

A first embodiment of the spar tensioning system is shown in FIGS. 2–4. In this embodiment, the spar has a collar 76 rotatably mounted thereon at a location either above or below the surface of the water. A pair of tension members 78, such as cables or chains, couple collar 76 to the tanker. Specifically, one end of each tension member 78 is connected to an eyelet 80 near the outer end of the corresponding bow horn 72 and the opposite end of the tension member is coupled to a constant tension device 82 mounted on the tanker near the rear end of the corresponding bow horn. Each tension member 78 passes down and about a sheave 84 mounted on a respective side of collar 76 (FIG. 4); thus, the two portions of each tension member extending upwardly from the corresponding sheave 84 are at acute angles relative to the longitudinal axis of spar 12. Also, members 78 extend upwardly and laterally outwardly (FIG. 4) to provide equal and opposite lateral force components on the spar to keep it substantially centered between the bow horns to prevent impact therewith.

Under maximimum storm conditions, a typical tension applied to the spar by tension members 78 is 300 tons. Such a load requires a heavy-duty construction for each tension member. A suitable chain for this purpose is 4-inch, superstrength, Di-Lok. Each link of such a chain is 24 inches long and 15 inches wide. Proof tests of this chain include the application of loads up to 600 tons. All sheaves used with this type of chain will be shaped to fit these links as commonly used in a wildcat windlass. This chain size should be satisfactory for resident tanker service, i.e., where the tanker remains permanently connected to the spar by way of the chains. If a transit tanker is to be coupled to the spar, the chain will need only a smaller fraction of the strength required for resident tanker service since a transit tanker will be in berth only under less severe sea conditions. Also, the average transit tanker will be smaller than the average resident tanker.

As wave loads exerted on the spar increase, the tanker, because it is coupled to the spar by tension members 78, puts a greater load on the spar which, in turn, becomes more resistant to transverse wave loads to minimize bending of the spar. This spar design tends to compensate for wave loads on the spar itself and reduces resulting stresses thereon. Moreover, the spar tends to remain upright because of the buoyancy of buoyancy tank 74 and the geometry of the tension system. When the spar is in its upright position (FIG. 2*a*), the portions of each tension member 78 extending away from the corresponding sheave 84 make substantially the same angle with the longitudinal axis of the spar so that the resultant tension force T is generally vertical.

The main purpose in allowing spar 12 to articulate is to allow it to follow horizontal movements of the tanker rather than moving relative to and out of phase with the tanker and then impacting with it which would cause damage to either or both of them. For instance, if the spar is caused to articulate or tilt slightly toward the tanker as shown in FIG. 2, sheaves 84 will move a short distance along respective tension members 78 so that there will be an unbalanced force in the forward direction, i.e., to the right when viewing FIG. 2, which will contribute to the buoyant force of buoyancy tank 74 to return the spar to its normally upright position. Similarly, if the spar tilts in the direction opposite to that of FIG. 2, the opposite effect will occur.

The tensioning system of FIGS. 2–4 also operates to position and keep the spar centrally between and spaced from bow horns 72 and forwardly of and spaced from bow 20. The tensioning system also allows the tanker to pitch relative to the spar yet the tanker and spar remain coupled together and the spar remains substantially centered between the bow horns. Also, the spar can be disengaged from and re-engaged with the tanker without assistance from additional marine craft. Differential vertical forces exerted on the tanker are compensated for by the tension system supplied by tension members 78.

The spar needs both anchorage and buoyancy to keep it in an upright position. Base 14 provides the anchorage as mentioned above to achieve the desired negative buoyancy. By balancing the buoyancy force of the buoyancy tank 74 and the anchorage supplied by ballast in base 14, the spar can be designed for towing, submerging and final positioning with little or no recourse to air chambers.

While the tensioning means 82 has been described as a constant tension device, this is only for purposes of illustration because there are other ways of providing the constant tension for tension members 78. For instance, a counterweight can be mounted on the tanker bow or spar and coupled to tension members 78 so as to provide the desired tension thereon, such as about 300 tons. This value of tension should be adequate to deal with 50-year recurrence storms, but is far in excess of normal requirements. The counterweight could possibly be of the variable type, such as one filled with seawater or other fluid so that it could be adjusted to changing sea conditions.

A variable tension could be applied to tension members 78 by way of one or more air cylinder and piston assemblies. Such an assembly might typically be about 50 feet long, 30 inches in diameter, and operate under a pressure of 1,000 psi under extreme weather conditions.

Motion compensators are also commercially available for applying constant tension to tension members 78. These devices are commercially available from suppliers to the offshore drilling industry. Some types of motion compensators involve multiple cables and sheaves; thus, they are not as practical for use as constant speed winches or a counterweight. Under the constant motion of a tanker in the open sea, the movement of cables over sheaves would possibly result in excessive wear of the sheaves and the cables. However, cable type motion compensators might possibly be suitable or adequate.

In some instances, heavy nylon hawsers could be used to maintain tension on the spar. The overall length of nylon hawser would be such that maximum elongation does not exceed 25 percent. Within this limit, nylon is resilient.

A swivel unit 90 (FIGS. 8 and 9) is mounted on the upper end of spar 12 to allow rotation of tanker 22 about spar 12. Swivel unit 90 includes an elongated tubular swivel core 92 mounted by spaced upper and lower bearings 94 and 96 to the upper part of spar 12 so that core 92 can rotate relative to the spar. A number of delivery hoses 98 (only one of which is shown in the drawings) communicating with the interior of core 92 are connected to a support 100 (FIG. 2) mounted on the bow of the tanker. The support has flow lines (not shown) coupled to hoses 98 to direct crude oil from respective flow lines on the spar to the gas-oil process facilities on the tanker or to a storage tank therein.

A well-control conduit 102 extends downwardly through the center of core 92 and can carry as many as 60 or more high-pressure, small diameter hydraulic lines and six electric downhole pressure indicator lines. Conduit 102 is fixed relative to the spar so that core 92 rotates about conduit 102. A well-control swivel 104 is mounted on the upper end of conduit 102 and has an umbilical cable 106 which extends to the tanker. Cable 106 is coupled to the various lines in conduit 102.

There may be several flow lines from subsea wells extending upwardly through the spar to a region adjacent to core 92. Typically, there will be seven hydraulic flows through the swivel, six of which will be for use in directing crude oil upwardly and into core 92 for transit through pipe 98 to the tanker. The seventh line will be used for well test purposes and will be used to direct natural gas or crude oil back down the spar and then to a nearby transit tanker berth or by pipeline to a receiving terminal on the shore. For purposes of illustration, three such flow lines are coupled by respective swivels to core 92 at corresponding locations along the length of the core. As shown in FIG. 8, there is an upper swivel 108, a middle swivel 110 and a lower swivel 112, all three swivels being rotatably mounted on core 92 and having suitable seals at the core-swivel junctions to assure a fluidtight connection therebetween. Any number of flow systems can be accommodated using this general arrangement. Flow lines 114, 116 and 118 are coupled to respective swivels 108, 110 and 112.

Core 92, for purposes of illustration, is divided into three compartments, 120, 122 and 124, compartment 124 communicating with flow line 118 as shown in FIG. 9. Flow lines 114 and 116 are similarly in communication with compartments 120 and 122, respectively. Well-head pressure, if sufficient, will cause crude oil to be pumped through flow lines 114, 116 and 118. Pumps can also be used for this purpose. There will be respective delivery hoses 98 in fluid communication with the three compartments 120, 122 and 124. Thus, regardless of the angular position of the tanker relative to the spar, there will be a flow of crude oil through hoses 98 to the tanker. In the alternative, the spar could have a flow line manifold. In such a case, only one hose 98 would be required.

An access man-way 126 is provided in the upper end of the spar as shown in FIGS. 8 and 9. The depth to which the man-way extends generally will be at least to buoyancy tank 74 and possibly below the same.

Another embodiment of the tensioning system of the present invention is shown in FIGS. 10–12 wherein the upper portion of the spar is provided with a mooring swivel 130 rotatably mounted thereon above buoyancy chamber 74 on spar 12 as shown in FIG. 10. The spar also has a slip ring 132 rotatably mounted thereon between a pair of bow horns 134 on the bow 20 of the tanker. A first pair of tension members 136 are secured at their lower ends to respective sides of mooring swivel 130, and tension members extend upwardly to and over a common sheave 138 on bow 20 and then pass to a constant tension device 140, such as a constant tension winch. Thus, members 136 exert a tension force on spar 12. The location of mooring swivel 130 along the length of spar 12 is such that angle A (FIG. 10) between each tension member 136 and the longitudinal axis of spar 12 is quite shallow, such as 10° to 15°. Tension members 136 are located at this angle relative to the spar so that there will always be a lateral component 137 of the tension force T exerted along each tension member 136 to urge the spar toward the tanker. In this way, the spar and tanker are kept from moving out of phase with each other so as to avoid damage due to impacting of the two together.

A second pair of tension members 142 is coupled at the front ends thereof to respective sides of slip ring 132, then to respective sheaves 144 near the outer ends of respective bow horns 134, then to respective constant tension devices 146 on opposite sides of the bow as shown in FIG. 12. Tension members 142, when cooperating with slip ring 132, maintains the spar centrally located between bow horn 134 and spaced forwardly of the bow of the tanker to prevent impact of the spar and the tanker itself. Also, tension members 142 allow the tanker to pitch relative to the spar. The buoyancy force of buoyancy tank 74 is aided by the tension force of tension members 136 to bias or urge the spar into its normally upright position.

FIG. 10 shows a substantial windvane position of the spar relative to the tanker, and FIG. 11 shows a substantial override position of the spar relative to the tanker. Typically, the inclination of the spar in the windvane position is about 20° and in the override position is about 10°. In both cases, the spar remains centered between and spaced from the bow horns by tension members 142 and tension members 136 continue to be at an angle relative to the longitudinal axis of the spar.

The embodiment of FIGS. 13–15 is very similar to that of FIGS. 10–12 in that it has a rotatable mooring swivel 130 above buoyancy tank 74 and a pair of tension members 136 which extend upwardly to and over a common sheave 138 on the bow of the tanker and then to a constant tension device 140. Instead of slip ring 132 and tension members 142 of FIGS. 10–12, the embodiment of FIGS. 13–15 has a modified bow horn structure 148 in which a V-shaped notch or recess 150 (FIG. 15) is provided at the forward extremity and three or more angularly spaced rollers 152 are mounted on structure 148 near the rearmost portion of the notch for rotation about respective horizontal axes. The rollers operate to engage the adjacent part of the spar at all times. Spar 12 is held in rolling contact with rollers 152 by the lateral component 137 of the tension force T applied by angled tension members 136 to mooring swivel 130, yet the spar is biased in a normally upright position by the buoyancy force of buoyancy tank 74. FIG. 13 shows a substantial windvane position of the spar relative to the tanker; and FIG. 14 shows a substantial override position of the spar.

The way in which wave action affects the relative positions between the spar and the tanker is illustrated in FIGS. 16, **16*a*, 16*b* and 17. The tensioning system of FIGS. 10–12 is assumed to be the coupling means for purposes of discussion hereinafter. In FIGS. 16 and 16*a*, the effects will be considered at the crest of a wave, and FIGS. 16*b* and 17** illustrate the effects at the trough of a wave.

The crest of the wave (FIG. 16) is denoted by the numeral 210 and the direction of the wave is from right to left as indicated by arrow 208. Thus, as conventionally considered, the wave particle motion will be circular as indicated by circles 214, 216 and 218 and of progressively decreasing diameter as the circles extend downwardly and away from crest 210.

In practice, the wave will have its greatest force at the surface 18, the wave force being less intense as the depth increases. The force of the wave action will be exerted at various locations along the spar, the individual forces at such locations being denoted by arrows 220 extending to the left.

FIG. **16*a* shows the resolution of the various forces exerted on the spar when the spar is in the inclined attitude of FIG. 16, assuming the wave crest is passing and wave direction is from right to left as denoted by arrow 208. In this case, the forces exerted on the spar by the wave action and the component 137 of the tension force of each tension member 136 exceed the lateral component of force 139 due to the buoyancy force 141 of buoyancy tank 74. Thus, the spar is maintained in its normal coupled relationship with the bow of the tanker and there is substantially no problem of tanker separation from the spar due to wave action (FIG. 16**).

When the wave trough is passing and wave direction is in the direction of arrow 208, the wave forces on the spar are in the direction of arrows 222 (FIG. **16*b*) and the spar may assume the inclined attitude opposite to that of FIG. 16*a*. In the alternative, the spar may remain generally upright although, in general, it will be slightly inclined in one direction or another. Assuming that the inclination of the spar is as shown in FIG. 16*b*, lateral components 137 of the tension force due to tension members 136 and lateral components 139 of the buoyancy force 141 of buoyancy tank 74 must be at least as great as the sum of the forces of the wave action denoted by arrow 222. Since the tension of the tension members 136 is relatively large, such as 300 tons or more, the lateral component 137 will be relatively large so as to keep the spar effectively coupled to the tanker even during extreme conditions, such as being subjected to the trough of a 60-foot wave in the direction of arrow 208 of FIG. 16. Even assuming that the spar is in a generally upright position when the wave strikes the spar, lateral component 137 will continue to counterbalance the force of the wave or even exceed the force of the wave without the assistance of component 139, for in the upright position, component 139 will not exist because the buoyancy force 141** will be coincident with the longitudinal axis of the spar.

In considering the relationship to the tanker and the spar at the trough 230 of a wave moving in the direction of arrow 208 (FIG. 17), the wave action is assumed to rotate in the direction of arrow 232 and thereby exert lateral forces 234 along various locations of the spar. In such a case, the lateral component 137 of the tension due to member 136 must counterbalance these forces 234 as well as the lateral component 139 of buoyancy forces 141 if spar 12 is inclined to the left as shown in FIG. 16*a*. If inclined to the right as shown in FIG. 16*b*, lateral components 137 and 139 are in the same direction and are additive, the sum of these components then serving to counterbalance wave forces 234. The tension of members 136 will be sufficiently great such that component 137 will have a magnitude at least equal to or greater than the sum of the forces comprised of component 139 and forces 234 due to the wave action.

For wave action at the trough for waves moving in the direction opposite to arrow 208, the lateral forces 236 will be the forces due to wave action and these lateral forces will be in the same direction as lateral component 137. Thus, this will be a condition in which there will be substantially no tanker separation problems and the spar and the tanker will remain effectively coupled together. This configuration allows the tanker to disengage from the mooring under severe weather conditions without assistance from other marine craft and without having workmen exposed on the tanker bow by simply releasing the connecting cable.

We claim:

1. A materials delivery system for the transfer of mined materials from the bottom of a body of water to the water surface comprising: a spar having means at one end thereof for mounting the same in a generally upright position on the bottom of said body of water with the spar having a length sufficient to permit it to extend to a location adjacent to the water surface, there being a material delivery line capable of transporting said materials and extending along the spar from a location adjacent to said mounting means to a location adjacent to the upper end of the spar, said delivery line adapted to be coupled to a materials receiver near the water surface when the spar is in said position; and means coupled with the spar near the upper end thereof for coupling the spar to the materials receiver and for applying a generally upward force to the spar when the spar is in said position, the upper end of the spar being movable laterally when the spar is mounted in said upright position and as said upward force is applied thereto, whereby the spar can move laterally with the materials receiver.

2. A system as set forth in claim 1, wherein the delivery line extends through at least a major portion of the spar and is carried thereby.

3. A system as set forth in claim 1, wherein the delivery line is externally of at least a major portion of the spar and is carried thereby.

4. A system as set forth in claim 1, wherein the mounting means comprises a base having means for anchoring the same to the bottom of said body of water, and including means defining a connection between the spar and the base to permit articulation of said spar and thereby lateral movement of the upper end of the spar relative to said base.

5. A system as set forth in claim 4, wherein said connection defining means comprises a ball joint.

6. A system as set forth in claim 4, wherein said connection defining means comprises a U-joint.

7. A system as set forth in claim 4, wherein said connection defining means comprises an elastic joint.

8. A system as set forth in claim 1, wherein the coupling and force applying means comprises a buoyancy tank near the upper end of the spar for applying a first force thereon at a first location below and adjacent to the upper end thereof, and flexible means coupled to the spar at a second location between said upper end and the first location and adapted to be coupled with said materials receiver for exerting a second force on the spar with the second force having a component extending transversely of the longitudinal axis of the spar.

9. A system as set forth in claim 1, wherein said coupling and force applying means includes flexible structure adapted to be coupled to said materials receiver for applying a constant tension force to said spar.

10. A system as set forth in claim 9, wherein is included a swivel mounted on the spar said flexible structure being coupled to said swivel.

11. A system as set forth in claim 1, wherein the delivery line comprises a fluid flow line, said spar having a tubular core rotatably mounted thereon adjacent to the upper end thereof, said core being rotatable about the longitudinal axis of the spar and having means for transferring a fluid therefrom to the receptacle, and means coupling said fluid flow line to the core and permitting the core to rotate relative to said fluid flow line.

12. A system as set forth in claim 11, wherein said means for coupling the fluid flow line to the core includes a swivel mount having a fluid passage therethrough for placing the fluid flow line in fluid communication with the core.

13. A materials delivery system for the transfer of mined materials from the bottom of a body of water to the water surface comprising: a spar having means at one end thereof for mounting the same in a generally upright position on the bottom of said body of water, the spar having a length sufficient to permit it to extend to a location adjacent to the water surface and having a ballast tank thereon near the normally lower end thereof, there being at least one materials delivery line capable of transporting said materials and extending along the spar from a location adjacent to said mounting means to a location adjacent to the upper end of the spar, said materials delivery line adapted to be coupled to a materials receiver on the water surface when the spar is in said position; a buoyancy tank on said spar near the upper end thereof for applying a buoyancy force thereto, said spar having a swivel rotatably mounted thereon above said buoyancy tank; and flexible means coupled with said swivel and adapted to be coupled with said materials receiver for applying a generally upward force to the spar and for keeping the upper end of the spar at a substantially fixed position relative to the materials receiver when the spar is in said position, the upper end of said spar being movable laterally relative to its lower end when the spar is in said position and as said buoyancy and tensions forces are applied thereto.

14. In combination: means defining a materials receiver capable of floating near the surface of a body of water; a spar having means at one end thereof for mounting the same in a generally upright position on the bottom of said body of water with said spar having a length sufficient to permit it to extend to a location adjacent to the water surface and said materials receiver; means rotatably coupled with the spar near the upper end thereof for coupling said spar to the materials receiver, for applying a generally upward force to the spar, and for keeping the upper end of the spar in a generally fixed location relative to the materials receiver when said spar is in said position, the upper end of said spar being movable laterally when said force is applied thereto, the spar having a materials delivery line capable of transporting said materials and extending along the same from a location adjacent to said mounting means to a location adjacent to the upper end of said spar; and means rotatably coupling said delivery line to the materials receiver to permit the latter to move about said spar as materials are delivered through said delivery line to the materials receiver.

15. A system as set forth in claim 14, wherein the delivery line extends through at least a major portion of the spar and is carried thereby.

16. A system as set forth in claim 14, wherein the delivery line is externally of at least a portion of the spar and is carried thereby.

17. A system as set forth in claim 14, wherein the mounting means comprises a base having means for anchoring the same to the bottom of said body of water, and including means defining a connection between the spar and the base to permit articulation of said spar and thereby lateral movement of the upper end of the spar relative to said base.

18. A system as set forth in claim 14, wherein said spar is flexible to permit its upper end to move laterally relative to the mounting means.

19. A system as set forth in claim 18, wherein the spar is rigidly connected to said mounting means.

20. A system as set forth in claim 14, wherein said tension applying means comprises a buoyancy tank mounted on the spar adjacent to the upper end thereof and on the portion thereof which is normally submerged when said spar is in said position.

21. A system as set forth in claim 14, wherein the force applying means comprises a buoyancy tank near the upper end of the spar for applying a first force thereon at a first location below and adjacent to the upper end thereof, and flexible means connected to the materials receiver and coupled to said spar at a second location between said upper end and said first location for exerting a second force on said spar with said second force having a component extending transversely of the longitudinal axis of said spar for biasing said spar toward said materials receiver.

22. A system as set forth in claim 21, wherein said flexible means includes structure carried by the materials receiver for applying a constant tension force to said spar.

23. A system as set forth in claim 21, wherein is included a swivel mounted on the spar at said second location, said flexible means being coupled to said swivel.

24. A system as set forth in claim 14, wherein the delivery line comprises a fluid flow line, said spar having a tubular core rotatably mounted thereon adjacent to the upper end thereof, said core being rotatable about the longitudinal axis of said spar and having means for transferring a fluid therefrom to said materials receiver, and means coupling the fluid flow line to the core and permitting said core to rotate relative to said flow line.

25. A system as set forth in claim 24, wherein said means for coupling the fluid flow line to the core includes a swivel mount having a fluid passage therethrough for placing the fluid flow line in fluid communication with said core.

26. A system as set forth in claim 14, wherein said materials receiver includes a vessel.

27. In combination: means defining a materials receiver capable of floating near the surface of a body of water; a spar having means at one end thereof for mounting the same in a generally upright position on the bottom of said body of water with said spar having a length sufficient to permit it to extend to a location adjacent to the water surface and said materials receiver; a buoyancy tank on said spar near the upper end thereof for applying a buoyancy force thereto, said spar having a swivel rotatably mounted thereon above said buoyancy tank; flexible means coupled with said swivel and to said materials receiver for applying a generally upward force to said spar and for keeping the upper end of the spar in a substantially fixed position relative to the materials receiver when the spar is in said position, said spar having a materials delivery line capable of transporting said materials and extending along the same from a location adjacent to said mounting means to a location adjacent to the upper end of said spar; and means rotatably coupling said delivery line to said materials receiver to permit the latter to move about said spar as materials are delivered through said delivery line to the materials receiver, the upper end of the spar being movable laterally when the spar is mounted in said upright position and as said upward force is applied thereto.

28. The combination of claim 27, wherein the materials receiver includes a vessel having a pair of spaced bow horns, the upper end of the spar being between said bow horns, said flexible means being coupled to said swivel, extending toward the bow of the vessel, and being operable to keep the upper end of the spar substantially spaced from the sides of the bow horns, there being a constant tension device carried by said vessel, spaced from said bow horns, and coupled with said flexible means for exerting a substantially constant tension thereon.

29. The combination as set forth in claim 28, wherein said swivel is below the bow horns and has a pair of spaced sheaves rotatably mounted thereon, said flexible means including a flexible member for each sheave, respectively, each flexible member having a first end coupled to a respective bow horn near the outer end thereof and a second end coupled to said constant tension device, each flexible member being coupled with the corresponding sheave.

30. The combination as set forth in claim 28, wherein the spar has a slip ring rotatably mounted thereon between the bow horns, and flexible structure coupling said slip ring to said bow horns to keep said slip ring and thereby the upper end of said spar in spaced relationship to said bow horns.

31. The combination as set forth in claim 28, wherein said vessel has a bow projection defining a substantially V-shaped recess, there being a number of angularly spaced rollers rotatably mounted on said projection at the base of the recess, the flexible means being inclined relative to the longitudinal axis of the spar to present a component of the tension force substantially transverse to said longitudinal axis, said component being operable to maintain said spar in engagement with said rollers.

32. A method of transferring materials from the bottom of a body of water to a floating materials receiver near the water surface comprising: providing a tubular spar defining a materials delivery path between the bottom of said body of water and a location adjacent to the water surface with the upper end portion of said path being capable of lateral movement relative to the lower end portion of the path; coupling the upper end portion of said spar to the materials receiver and applying an upward force on the spar with the source of the force being on the materials receiver to maintain the upper end portion of said spar in a generally fixed location relative to said materials receiver as the latter rotates about and pitches relative to said path; and directing a mass of materials along said path while permitting said materials receiver to rotate about and to pitch relative to said path.

33. A method as set forth in claim 32, wherein said maintaining step includes applying a upward tension force to said path with said force having a component extending transversely of said path.

34. A method as set forth in claim 32, wherein said maintaining step includes applying a buoyant force to said path.

35. A base for mounting one end of a spar of a materials delivery system on the bottom of a body of water comprising: a hollow housing adapted to be mounted on the bottom of said body of water and having means thereon for mounting the spar thereon when said housing is disposed on said bottom, said housing having a lower skirt for embedding into said bottom, said skirt forming an enclosed space when the skirt engages said bottom; means communicating with said space when the same is formed for coupling the space to a source of reduced fluid pressure to facilitate the insertion of said skirt into said bottom; and conduit means coupled with said housing for permitting a fluidized ballast to be directed into or removed from said housing.

36. A base as set forth in claim 35, wherein said conduit means includes a first tube, said space coupling means including a second tube.

37. A base as set forth in claim 35, wherein said mounting means includes a ball joint.

38. A base as set forth in claim 35, wherein said mounting means includes a U-joint.

39. A base as set forth in claim 35, wherein said mounting means includes a resilient pad.

40. A base as set forth in claim 35, wherein said housing has means thereon for providing a positive buoyancy therefor, and including a slurry flowable into the housing through said conduit means for providing a negative buoyancy for said housing.

41. A materials delivery system for the transfer of mined materials from the bottom of a body of water to the water surface comprising: a spar having means at one end thereof for mounting the same in a generally upright position on the bottom of said body of water with the spar having a length sufficient to permit it to extend to a location adjacent to the water surface, there being a material delivery line capable of transporting said materials and extending along the spar from a location adjacent to said mounting means to a location adjacent to the upper end of the spar, said spar having means for coupling the same to a materials receiver on the water surface when the spar is in said position with said coupling means being operable to apply a first, generally upward force on the spar when it is coupled to the materials receiver; and means coupled with the spar near the upper end thereof for applying a second, generally upward force thereto when the spar is in said position, the upper end of the spar being movable laterally when the spar is mounted in said upright position and as said upward forces are applied thereto.

42. A system as set forth in claim 41, wherein the force applying means comprises a buoyancy tank near the upper end of the spar for applying said second force thereto at a first location below and adjacent to the upper end thereof, said coupling means of the spar being at a second location thereon between said upper end and the first location and being operable to exert said first force in a direction to cause the first force to have a component extending transversely of the longitudinal axis of the spar.

43. A system as set forth in claim 41, wherein said coupling means includes structure for applying a constant tension force to said spar.

44. A system as set forth in claim 41, wherein is included a swivel mounted on the spar near the upper end thereof, said coupling means being coupled to said swivel.

45. A system for use in communicating between the bottom of a body of water and a receiver buoyant in the water comprising: a spar having means at one end thereof for mounting the same in a generally upright position on the bottom of said body of water; and means carried by the spar for coupling the same to the receiver and for applying a generally upward force to the spar when the spar is in said upright position, the upper end of the spar being movable laterally when the spar is mounted in said upright position and as said upward force is applied thereto, whereby the spar can move laterally with the receiver.

46. A system as set forth in claim 45, wherein the spar is tubular.

47. A system as set forth in claim 45, wherein the coupling means is near the upper end of the spar.

48. A system as set forth in claim 45, wherein the coupling means includes flexible structure adapted to be coupled to the receiver for applying a generally constant tension force on the spar.

49. A system as set forth in claim 45, wherein is included a receiver buoyant in said body of water, said coupling means being coupled to said receiver.

* * * * *